US005092501A

United States Patent [19]

Potucek

[11] Patent Number: 5,092,501

[45] Date of Patent: Mar. 3, 1992

[54] COAT HANGERS HAVING UNIQUE CROSS SECTIONS MADE OF WIRE

[75] Inventor: Frank Potucek, West Palmetto, Fla.

[73] Assignee: Star Resources Group, Inc., Birmingham, Ala.

[21] Appl. No.: 482,467

[22] Filed: Feb. 21, 1990

[51] Int. Cl.[5] ..... A47G 25/28; A47G 25/52; A47G 25/14

[52] U.S. Cl. ..... 223/85; 223/92; 223/95; D6/317

[58] Field of Search ..... 223/85, 88, 92, 95; 72/224; 140/81.5; 52/738, 739; 211/113; D6/317, 315

[56] References Cited

U.S. PATENT DOCUMENTS

| | | | |
|---|---|---|---|
| 477,412 | 6/1892 | Hasse | 223/88 |
| 3,289,901 | 12/1966 | Zwanzig | 223/88 |
| 3,480,245 | 11/1969 | Gingher | 223/85 |
| 4,026,446 | 5/1977 | Kessler | 223/88 |
| 4,776,195 | 10/1988 | Fukuhara | 72/224 |
| 4,791,772 | 12/1988 | Potucek | 52/738 |
| 4,833,906 | 5/1989 | Potucek | 72/224 |
| 4,858,457 | 8/1989 | Potucek | 72/224 |

FOREIGN PATENT DOCUMENTS

| | | | |
|---|---|---|---|
| 837179 | 6/1960 | United Kingdom | 223/85 |

*Primary Examiner*—Werner H. Schroeder
*Assistant Examiner*—Bibhu Mohanty
*Attorney, Agent, or Firm*—Joseph C. Mason, Jr.; Ronald E. Smith

[57] ABSTRACT

Wire coat hangers having transverse cross sections of unique configuration. In a first embodiment, the hanger has a rounded, generally "T"-shaped configuration when seen in transverse section. In a second embodiment, the cross section of the hanger has the configuration of a five pointed star with circumferentially and equidistantly spaced and radially extending fins having a common extent and having round distal free ends. Other embodiments have various star-shaped cross sections and include two to twelve fins. In all embodiments, the unique cross sectional shapes are achieved by roll forming or drawing. In the "T"-shaped configuration, a 62% reduction in material is achieved, and in the star-shaped configuration, a 50% reduction in materials is attained. The new coat hangers therefore use much less material than conventional round in section coat hangers, but are about equally strong.

12 Claims, 2 Drawing Sheets

COAT HANGERS HAVING UNIQUE CROSS SECTIONS MADE OF WIRE

TECHNICAL FIELD

This invention relates, generally, to improvements in coat hangers. More particularly, it relates to a coat hanger having less than half the material of a conventional coat hanger but possessing increased strength per unit weight.

BACKGROUND ART

Conventional wire coat hangers are made by bending wire into the well known shape. The wire that is commonly used has a round transverse cross section. Accordingly, the wire does not bend easily when subjected to loads and therefore easily supports articles of clothing.

About the only improvements that have been made to wire coat hangers over the years have related to improvements in the quality of the wire being used, but the basic structure of the device has remained unchanged. Moreover, a considerable amount of experimentation has been conducted with wire diameters, in an effort to find the optimal wire diameter. However, the cross sectional shape of the wire has remained round throughout all of these experimentations.

DISCLOSURE OF INVENTION

The long moribund art of coat hanger design is now stirred by the disclosure of a wire coat hanger having plural embodiments of non-round cross sections. The new cross sectional shapes enable the production of coat hangers that use less than half the materials of conventional round in section hangers while exhibiting dramatically increased strength.

In a first embodiment, a round wire is worked by a pair of confronting form rollers each of which has a uniquely configured rolling edge. The cross section of the formed wire has a generally rounded "T"-shaped configuration that is best understood in connection with the drawings appended hereto.

The unique "T"-shape greatly strengthens the coat hanger while simultaneously slashing the amount of metal required to make it.

In additional embodiments, plural roller members are equidistantly and circumferentially spaced with respect to one another and disposed in radial relation to the path of travel of the wire being worked. In a second embodiment, e.g., three rollers produce a wire having the cross section of a five pointed star and in additional embodiments, wires having star-shaped cross sections including two to twelve points or fins are disclosed.

The primary object of this invention is to revolutionize the coat hanger industry by providing a stronger coat hanger per pound while using less than half the materials required to make a conventional coat hanger.

Further objects and advantages will become apparent as this description proceeds.

The invention accordingly comprises the features of construction, combination of elements and arrangement of parts that will be exemplified in the construction set forth hereinafter and the scope of the invention will be set forth in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
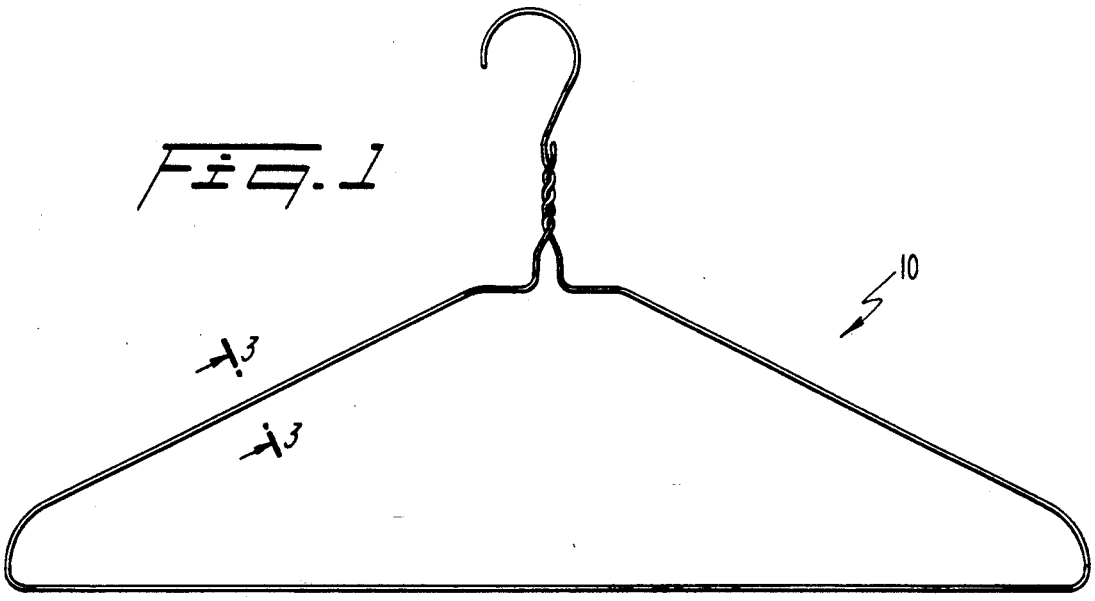
FIG. 1 is a view of a first exemplary embodiment of the novel coat hanger.

Referring now to FIG. 1, it will there be seen that an illustrative embodiment of the invention is denoted by the reference numeral 10 as a whole. Coat hanger 10, as is well known, is an integral structure formed by bending an elongate wire; accordingly, its specific structure need not be described.

Figure 2:
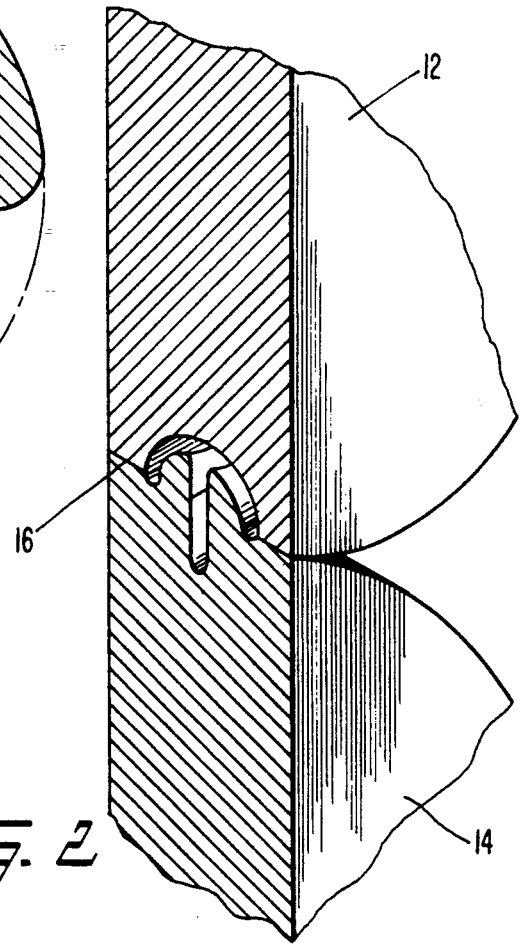
FIG. 2 is a perspective view of a pair of rollers employed to make the coat hanger of FIG. 1.

A simplified, schematic view of the manner of making the coat hanger of FIG. 1 is depicted in FIG. 2. Form rollers 12, 14 are preferably disposed in a vertical plane but that disposition is not critical. Moreover, a preforming stage of rollers could also be employed, but no preform rollers are shown to simplify the drawings.

FIG. 2 perhaps best illustrates the rounded "T"-shaped cross sectional structure of the coat hanger of FIG. 1 and the manner of making it. It will there be seen that upper roller 12 and lower roller 14 meet along parting line 16 and that the unique and heretofore unknown cross sectional structure of the coat hanger is created by complemental voids and protuberances formed in the respective peripheral edges of the rollers 12, 14.

Figure 3:
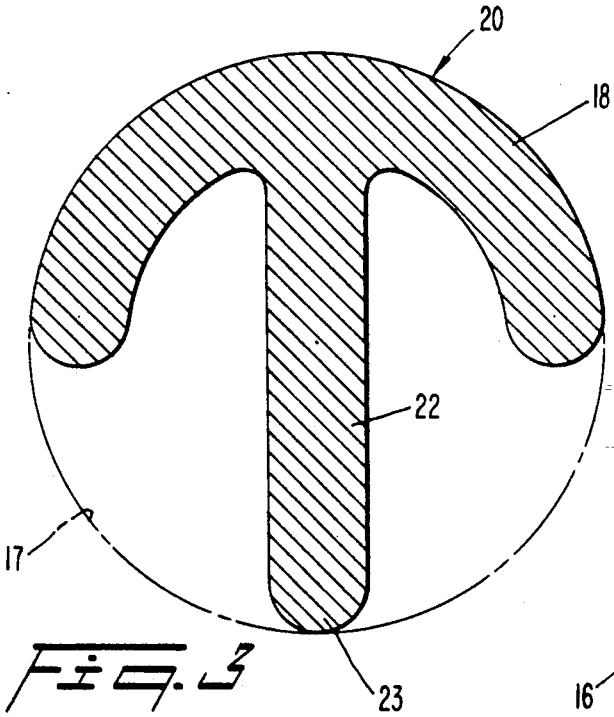
FIG. 3 is a transverse sectional view taken along line 3—3 in FIG. 1.

Imaginary circle 17 in FIG. 3 indicates the diameter of a conventional coat hanger wire. Accordingly, it will be understood that arcuate outer surface 18 of the arcuate part 20 of the novel coat hanger provides a rounded support surface for clothing just like the support surface of a conventional round in section hanger. It will be equally understood that the central rib 22 of the coat hanger, which is integral with top part 20 at its bight part as shown, terminates in a distal free end 23 that is coincident with imaginary circle 17.

It can be shown by mathematical techniques that the transverse cross sectional area of the coat hanger wire depicted in FIG. 3 is only 38% of the cross sectional area of the wire represented by circle 17, i.e., there is a 62% reduction in material. The unused material is in part longitudinally displaced along the extent of the original wire, and is in part radially displaced as well.

Figure 4:
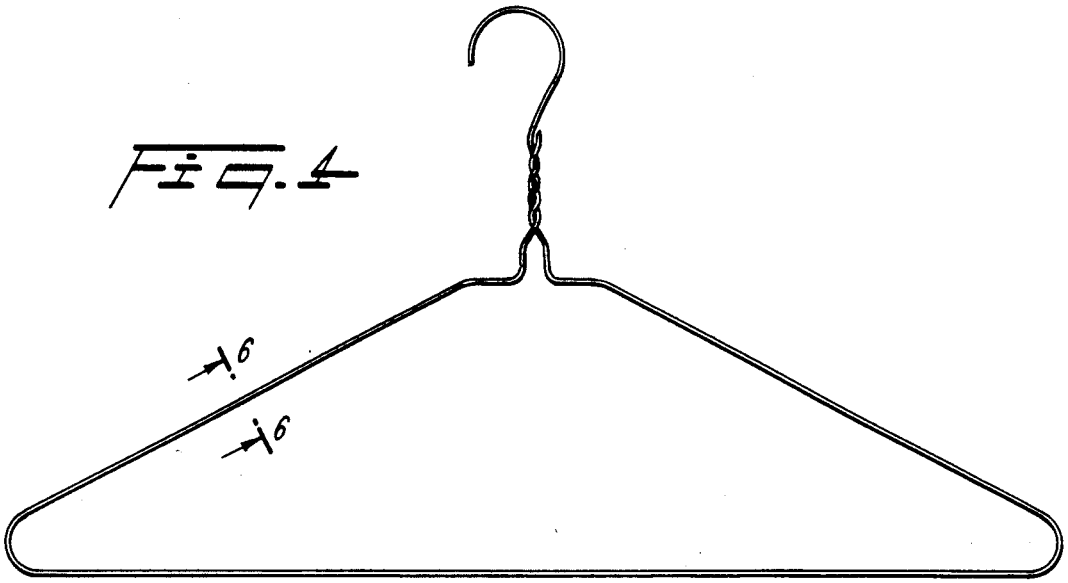
FIG. 4 is a view of a second exemplary embodiment of the novel coat hanger.
Figure 5:
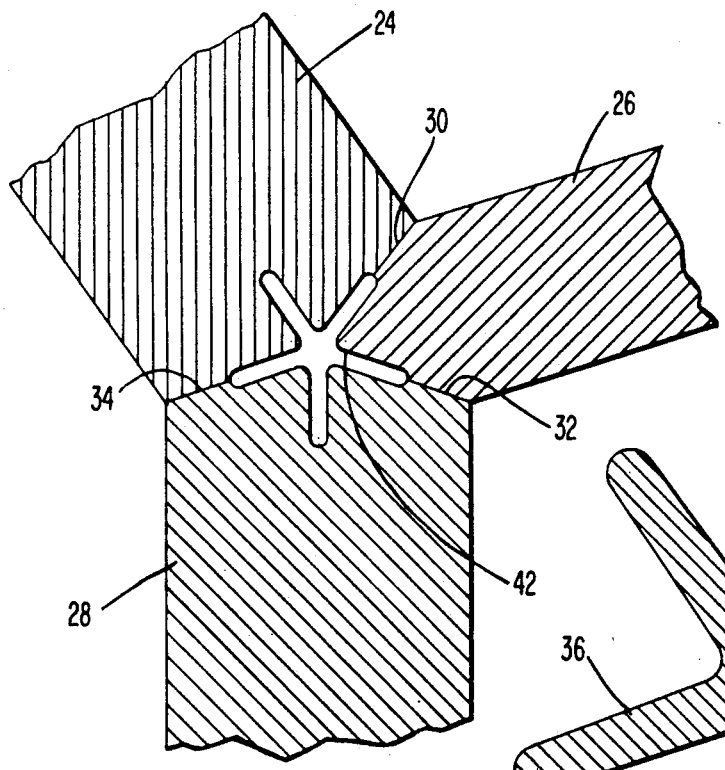
FIG. 5 is a cross-sectional view of three rollers employed to produce the coat hanger of FIG. 4.
Figure 6:
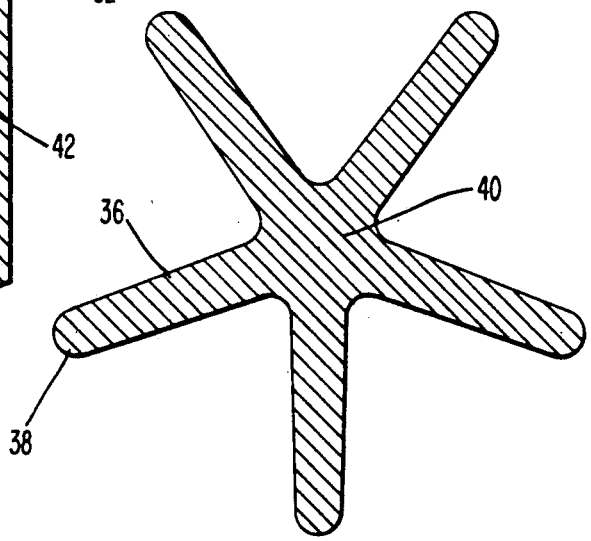
FIG. 6 is a transverse sectional view taken along line 6—6 in FIG. 4.

A second embodiment of the present invention is shown in FIGS. 4–6. The five pointed star configuration shown in FIG. 6 is produced by three circumferentially positioned form rollers 24, 26, 28, shown in FIG. 5, that meet, as shown along the parting lines 30 (rollers 24 and 26), 32 (rollers 26 and 28) and 34 (rollers 28 and 24) and which have voids or protuberances formed therein as shown to create the depicted cross sectional area. Each fin 36 has a rounded distal end 38 and is integral with central core 40; a longitunally extending concave bight 42 is formed along the base of contiguous fins by the rolling process. Note that the diameter of central core 40 is only about one fourth the diameter of a circle circumscribing the fins 36.

The cross sectional area of the wire in this embodiment is about 50% less than the cross section of a round in section wire. However, the roll forming process substantially strengthens the wire.

Similar roller arrangements could be employed to produce coat hanger wires having cross sectional structures having two to four points or fins and six-twelve points or fins in addition to the five finned embodiment shown in FIG. 4, i.e., star-shaped cross sections having two to twelve fins are within the scope of this invention.

The unique cross sectional configurations of the novel coat hangers can also be formed by the extrusion or drawing process.

It is therefore apparent that this invention is new and useful. Moreover, it was not obvious to those of ordinary skill in the art at the time it was made in view of the prior art, taken as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A coat hanger having a generally "T"-shaped transverse cross-section taken at any preselected position along the extent thereof;

said generally "T"-shaped cross-section including a first part of arcuate configuration and a second part of linear configuration, said first and second parts being formed integrally with one another; and said coat hanger being made of wire.

2. The coat hanger of claim 1, wherein said coat hanger is made from wire initially having a circular transverse cross section.

3. The coat hanger of claim 2, wherein the transverse cross sectional area of said coat hanger is about 60% less than the cross sectional area of a coat hanger having a round transverse cross section.

4. The coat hanger of claim 3, wherein said "T"-shaped cross section is formed by a pair of diametrically opposed form rollers.

5. The coat hanger of claim 4, wherein said "T"-shaped cross section is formed by wire drawing.

6. A coat hanger having a generally star-shaped transverse cross-section, said cross-section being taken at any preselected location along the extent of said coat hanger;

said cross-section including a predetermined plurality of equidistantly and circumferentially spaced apart fins that extend radially from a central core;

said fins and central core being integrally formed with one another;

each of said fins having a rounded distal free end;

a concave bight being formed at a base of each fin where it extends from said central core;

said predetermined plurality of fins being five in number; and said coat hanger being made of wire.

7. The coat hanger of claim 6, wherein said coat hanger is made of wire initially having a round transverse cross section.

8. The coat hanger of claim 7, wherein the transverse cross sectional area of said coat hanger is about 50% less than the transverse cross sectional area of a coat hanger having a round transverse cross section.

9. The coat hanger of claim 8, wherein said star-shaped cross section is formed by a plurality of circumferentially spaced rollers.

10. The coat hanger of claim 9, wherein said coat hanger is formed by wire drawing.

11. A wire-drawn coat hanger of one-piece integral construction that has a generally "T"-shaped transverse cross-section taken at any position along the extent thereof, said cross-section including a first part of arcuate configuration and a second part of linear configuration.

12. A wire-drawn coat hanger of one piece, integral construction that has a generally star-shaped transverse cross-section taken at any preselected position along the extent thereof, said hanger including a central core throughout its entire extent, a plurality of equidistantly and circumferentially spaced apart fin members that extend radially outwardly with respect to said central core, all of said fin members having a common radial extent, and a circle circumscribing radially outermost ends of said fin members having a diameter about four times greater than a diameter of said central core.

* * * * *